United States Patent [19]

Yasuda

[11] Patent Number: 4,907,295

[45] Date of Patent: Mar. 13, 1990

[54] IMPROVED DIVING WET SUIT

[75] Inventor: Mamoru Yasuda, Ishinomaki, Japan

[73] Assignee: Tohoku Diving Center Co. Ltd., Miyagi, Japan

[21] Appl. No.: 309,557

[22] Filed: Feb. 13, 1989

[30] Foreign Application Priority Data

Jul. 18, 1988 [JP] Japan ..... 53-93964[U]

[51] Int. Cl.[4] ..... A62B 17/00; B63C 11/04

[52] U.S. Cl. ..... 2/2.1 R; 2/79; 2/82; 2/272

[58] Field of Search ..... 2/2.1 R, 2, 82, 84, 2/79, 272

[56] References Cited

U.S. PATENT DOCUMENTS

| | | | |
|---|---|---|---|
| 3,731,319 | 5/1973 | O'Neil | 2/2.1 R X |
| 4,485,489 | 12/1984 | Pilie et al. | 2/2 |
| 4,561,121 | 12/1985 | Ehring et al. | 2/2 |
| 4,727,262 | 10/1987 | Insulan et al. | 2/2.1 R |

FOREIGN PATENT DOCUMENTS

| | | | |
|---|---|---|---|
| 66399 | 12/1982 | European Pat. Off. | 2/79 |
| 2594009 | 8/1987 | France | 2/2 |
| 96267 | 5/1985 | Japan | 2/2.1 R |
| 1583448 | 1/1981 | United Kingdom | 2/84 |
| 1599555 | 10/1981 | United Kingdom | 2/2.1 R |

*Primary Examiner*—H. Hampton Hunter
*Attorney, Agent, or Firm*—James Hellwege

[57] ABSTRACT

A diving wet suit comprises an inner shell having a body formed of a non-stretch material that is a flexible plastic sheet reinforced with a fabric and including a complete waterproof stretch material for a neck and both wrists and shoes for both feet and a waterproof fastener extending from the back to both arms of the body and an outer shell formed of a resin coated cloth and including pads in leg and hip portions and an opening extending from the back to both arms. The inner and outer shells are provided with holes for mounting valves in the breasts and shoulders so as to fixedly hold them between the valves. Included also are one area fastener provided in the vicinity of the waterproof fastener attached to the inner shell from the back to both arms and the other area fastener provided on the outer shell to join the inner and outer shells together.

1 Claim, 2 Drawing Sheets

1
11
12
13
14
15
31
32

IMPROVED DIVING WET SUIT

BACKGROUND OF THE INVENTION

1. Field of the Invention

The present invention relates to a wet suit for diving.

2. Statement of the Prior Art

A problem with a conventional diving wet suit is that when the wearer makes a dive into a reefy area, it is often damaged because of being formed of a single sheet, and is eventually so torn that it cannot be used.

A problem with a conventional shell type wet suit is that it is not photogenic in water, since it is too closely fitted to the wearer's body.

SUMMARY OF THE INVENTION

In view of the foregoing problems, an object of this invention is to provide a diving wet suit which comprises super-waterproof structure, is not damaged even when the wearer makes a dive into a reefy area, and is photogenic in water.

According to this invention, there is provided a diving wet suit comprising an inner shell having a body formed of a non-stretch material that is a flexible plastic sheet reinforced with a fabric and including a complete waterproof stretch material for a neck and both wrists and shoes for both feet and a waterproof fastener extending from the back to both arms of said body and an outer shell formed of a resin coated cloth and including pads in laps and hips and an opening extending from the back to both arms, said inner and outer shells being provided with holes for mounting valves in the breasts and shoulders so as to fixedly hold them between the valves, and including one area fastener provided in the vicinity of said waterproof fastener attached to said inner shell from the back to both arms and the other area fastener provided on said outer shell to join said inner and outer shells together.

BRIEF DESCRIPTION OF THE DRAWINGS

The present invention will now be explained in detail, by way of example alone, with reference to the accompanying drawings, in which.

DETAILED DESCRIPTION OF THE INVENTION

Figures 1, 2:
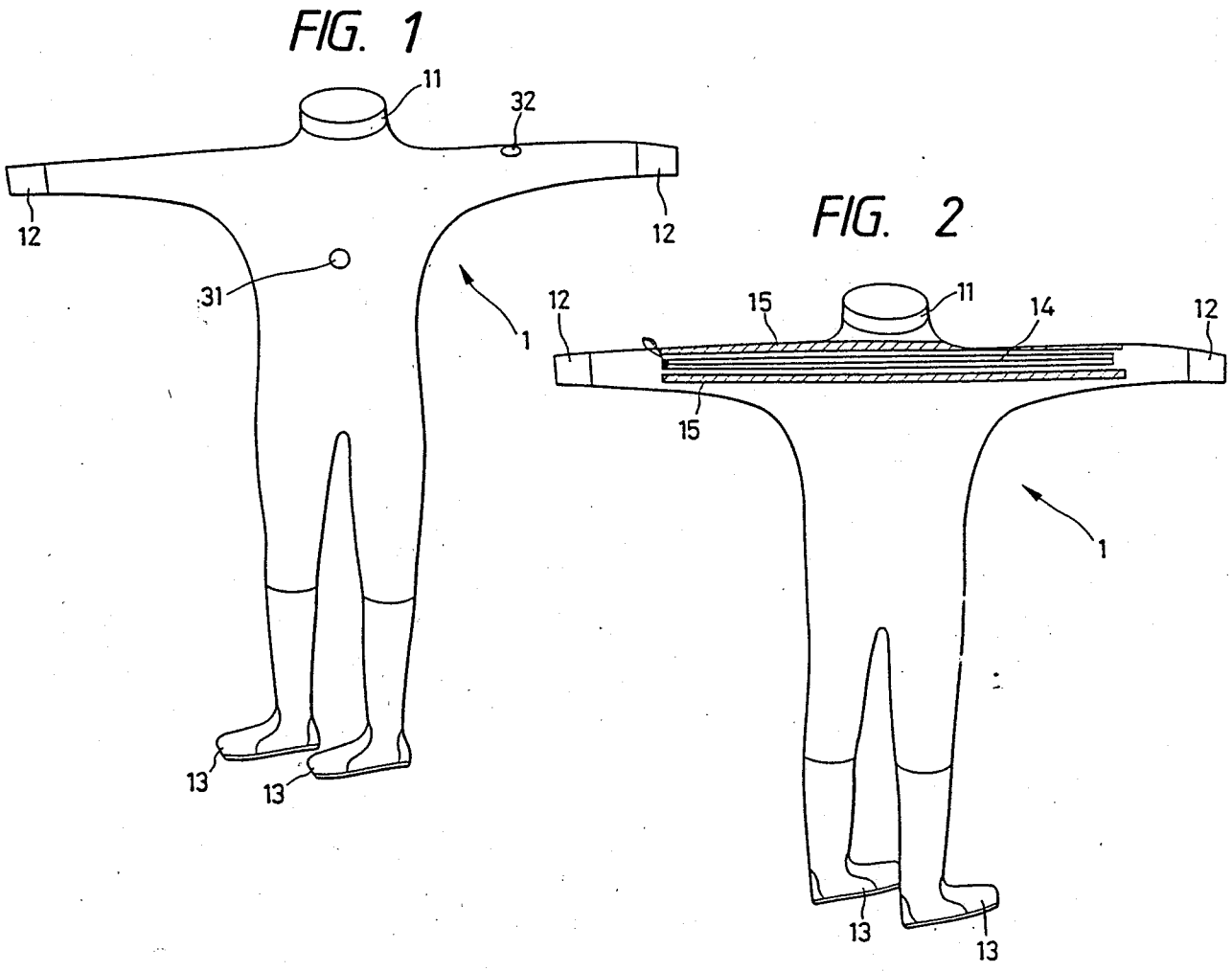
FIG. 1 is a front view of the inner shell used in one specific embodiment of the present invention.
FIG. 2 is a rear view of the inner shell.
Figure 4:
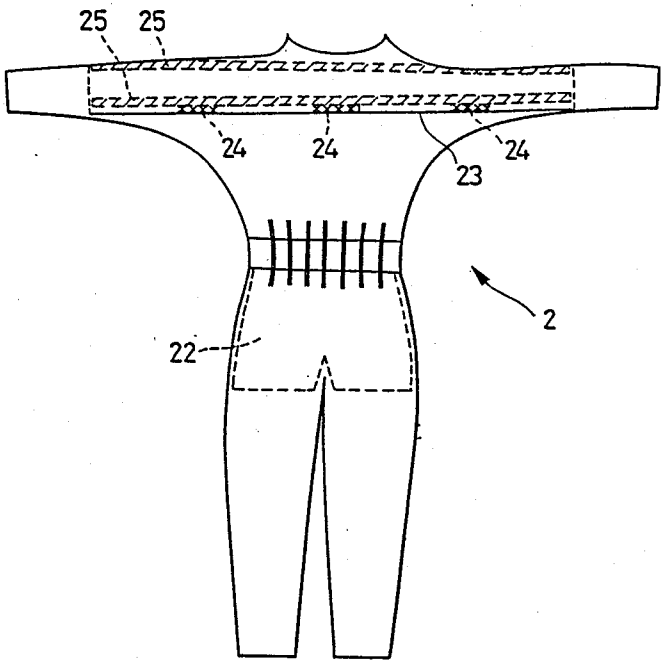
FIG. 4 is a rear view of the outer shell.
Figure 3:
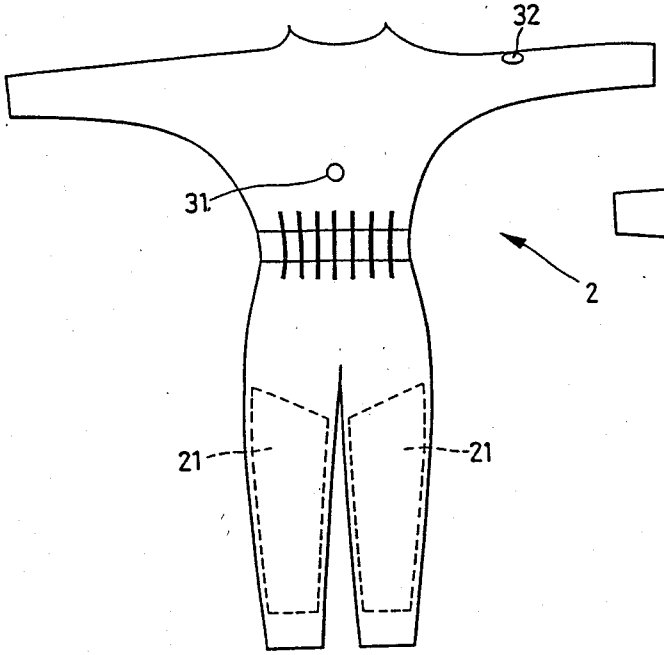
FIG. 3 is a front view of the outer shell used in one specific embodiment of the presnet invention.

A body of an inner shell generally shown at 1 is formed of a non-stretch material that is a flexible plastic sheet reinforced with a fabric. Various fabrics of natural or synthetic fibers may be used to this end. The flexible plastics used may be soft polyvinyl chloride or other soft plastics. The fabric is completely embedded in the flexible plastic to reinforce the sheet therewith. Although the inner shell may be fabricated in various manners, it should preferably be made by thermal fusion. As the material for the inner shell, use may be made of, e.g., PVC-tarpaulin.

Being in the aforesaid structure, the thus prepared inner shell excels in weather resistance, water resistance and oil resistance.

Being in the aforesaid structure, said sheet is non-stretch. Since the inner shell body is formed of a non-stretch material, it is possible to prevent an increase in the buoyancy of the inner shell 1 owing to its expansion.

The inner shell 1 includes a neck area 11, wrist areas 12 and shoes areas 13, all formed of a stretch material for complete waterproofness. That material may be natural or synthetic rubber or plastics. Such areas 11, 12 and 13 may be joined to the body of the inner shell 1 in various manners. However, particular preference is given to bonding. If the shoes 13 are formed by hard rubber boots, then the cut soles prevent the wearer from sliding on the wet deck.

As illustrated in FIG. 2, a waterproof fastener 14 is provided on the body of the inner shell 1 from the back to both arms for ease of placing on the body and ease of removal. Since the stretch material for complete waterproofness and the shoes are provided to the neck and both wrists and both feet, as mentioned above, in addition to the waterproof fastener 14, complete waterproofness is obtained.

An outer shell 2 comprises a resin coated cloth. Various cloths may be used to this end. In the instant embodiment, a nylon cloth is used. By using a variety of dyed nylon cloths and exposing them to open view, it is possible to obtain a diving wet suit of fashionable design. Since the outer shell is resin-coated on the inside, it is tough and serves to protect the inner shell. In view of design, it may be required to increase the number of regions to be sewn up. Even in this case, however, the desired design is obtained by sewing up the outer shell 2 alone with no need of any special waterproofing.

The outer shell 2 includes pads in lap areas 21 and a hip area 22. Such pads may be formed of various materials. In the instant embodiment, neoprene foam is used. Such pads serve to absorb shocks produced when the lap or hip areas strike upon rocks, etc. and protect the inner shell. The attachment of said pads to the outer shell 2 is achieved by sewing up alone without need of any waterproofing process. When partly reinforcing the lap or hip areas of a conventional dry suit of the single structure, it was required to apply reinforcements to the body or seal up the sewn regions after sewing up for the purpose of waterproofing. However, the instant embodiment is simple because waterproofing is achieved by sewing up alone.

The outer shell 2 is provided with an opening 23 extending from the back to both arsm, and an area fastener 24 is provided to said opening 23.

Said inner and outer shells 1 and 2 are provided with holes 31 and 32 for mounting valves in the breast and shoulder areas so as to fixedly hold the inner and outer shells 1 and 2 between the valves mounted. In this manner, the inner and outer shells 1 and 2 are joined together by the valves.

One area fastener is provided in the vicinity of the waterproof fastener attached to the inner shell from the back to both arms, and the other area fastener is provided on the outer shell, thereby joining them together. That is, as illustrated in FIG. 1, one area fastener 15 is provided in the vicinity of the waterproof fastener 14 attached to the inner shell 1 from the back to both arms, and the other area fastener 25 is provided on the outer shell 2 from the back to both arms, said other area fastener 25 being engageable with or disengageable from said one area fastener 15 of the inner shell 1.

Since the inner and outer shells 1 and 2 are joined together, the wearer can make a dive, while caring nothing for the double structure of the inner and outer shells 1 and 2.

The thus constructed diving dry suit according to the instant embodiment may be used in the following manner.

The inner and outer shells 1 and 2 are put upon each other, and the valves are mounted in the associated holes 31 and 32 to fixedly hold the inner and outer shells 1 and 2 between the valves. Then, one area fastener 15 provided in the vicinity of the waterproof fastener 14 of the inner shell 1 is integrally coupled to the other area fastener 25 provided to the outer shell 2 from the back to both arms. Afterwards, the wearer inserts his or her body into the dry suit from the opening 23 in the outer shell 2 and the waterproof fastener 14. Subsequently, the waterproof fastener 14 and opening 23 are closed up. Finally, cuffs attached to the neck, wrists and ankles of the outer shell 2 are put on.

The diving wet suit constructed as mentioned above is of the super-waterproof structure, is not damaged in terms of the waterproof structure even when the wearer makes a dive into a reefy area, and is photogenic in water.

Further, since the inner shell body is formed of a non-stretch material, it is possible to prevent an increase in the buoyancy of the inner shell due to its expansion.

Still further, since the stretch material for complete waterproofness is provided to the neck and both wrists and shoes are provided to both feet in addition to the waterproof fastener, complete waterproofness is obtained.

Still further, it is possible to obtain a diving wet suit of fashionable design by dyeing the cloth for the outer shell according to various designs and exposing it to open view. Since the outer shell is resin-coated on the inside, it is tough and serves to protect the inner shell.

It is also understood that since the outer shell can easily be processed with no need of waterproofing, fashionable designs can easily be obtained. Because the outer shell is replaceable, designs or colors can be changed by the replacement of the outer shell alone. The diving wet suit of this invention is also economical, since, if damaged, the outer shell can be replaced by new one.

What is claimed is:

1. An improved diving wet suit comprising an inner shell comprised of a body formed of a nonstretch material comprising a flexible fabric-reinforced plastic sheet, said inner shell further including neck, wrist and foot portions comprised of a stretchable waterproof material, said inner shell provided with an opening extending from a back portion along both arms, a waterproof fastening means extending from said back portion along both arms and adapted to seal said opening in said inner shell, an outer shell comprised of a resin-coated fabric, said outer shell provided with an opening extending from a back portion along both arms, fastening means provided in each said inner and outer shells adapted to join said inner and outer shells together along said opening in said outer shell, said inner and outer shells being provided with holes for mounting valves in the area of the breast and shoulders to permit said inner and outer shells to be fixedly held together between said valves, and said outer shell including pad means positioned adjacent hip and leg portions.

* * * * *